United States Patent [19]

Kim et al.

[11] 4,117,438

[45] Sep. 26, 1978

[54] CONTACTLESS KEYSWITCH FOR KEYBOARDS

[75] Inventors: Kirk J. Kim, Corona del Mar; Michael Muller, Newport Beach, both of Calif.

[73] Assignee: Datanetics Corporation, Fountain Valley, Calif.

[21] Appl. No.: 786,983

[22] Filed: Apr. 13, 1977

[51] Int. Cl.[2] ..... H01F 21/04; G08C 1/00

[52] U.S. Cl. ..... 336/75; 200/5 A; 200/159 R; 336/200; 340/365 L

[58] Field of Search ..... 200/5 R, 5 A, 292, 159 B; 336/200, 73, 75, 87, 131, 132; 340/365 L, 365 R; 178/17 C

[56] References Cited

U.S. PATENT DOCUMENTS

| | | | |
|---|---|---|---|
| 3,188,435 | 6/1965 | Rugsten | 200/292 X |
| 3,294,927 | 12/1966 | Hill | 200/5 R |
| 3,623,081 | 11/1971 | Scarbrough | 340/365 L |
| 3,668,697 | 6/1972 | Cochran et al. | 340/365 L |
| 3,683,371 | 8/1972 | Holz | 340/365 L |
| 3,740,746 | 6/1973 | Dureau et al. | 340/365 L |
| 3,757,068 | 9/1973 | Musch et al. | 200/159 R |

*Primary Examiner*—James R. Scott

*Attorney, Agent, or Firm*—Richard J. Rengel

[57] ABSTRACT

Inductive sensing keyswitch includes a printed circuit transformer and sheet of material having hinged metal flaps formed therein and each flap is resiliently biased against both printed circuit coils of the transformer for eddy-current shorting of both coils wherein keys on the keyboard have key stems passing through the printed circuit board between the printed coils and the flap hinges to provide a mechanical advantage for moving the flaps away from the printed circuit coils a greater distance than the short stroke movement of the key.

12 Claims, 7 Drawing Figures

CONTACTLESS KEYSWITCH FOR KEYBOARDS

BACKGROUND OF THE INVENTION

This invention relates generally to keyswitches and keyboards and the like and structural arrangements for providing electrical signals in response to actuation of individual ones of the keyswitches.

While various conventional arrangements of keyswitches for keyboards are known, including mechanical, inductive and capacitive, the advantages of prior contactless keyswitches using magnetic coupling, for example, are outweighed by the disadvantage of requiring relatively expensive and complex structure and circuit arrangements for producing output signals representative of actuated keys. In several of the prior art keyboard arrangements, inductive sensing elements of the switches in the keyboard matrix were not able to prevent an electromagnetic force in the secondary coil of a transformer sensing element of the keyswitch. Accordingly, a "dummy" keyboard array was provided to cancel the noise signals in the secondaries. Also, these transformer structural arrangements have a common problem in that the secondary is located in the shadow of the primary and in another plane, e.g. not coplanar which accounts in part for failure to eliminate electromotive forces requiring the duplicate keyboard array or other noise canceling coils.

Further, sensing by one turn elements in separate planes reduces the coupling efficiency substantially so that relatively large driving currents are required. Also, the effectiveness of eddy current shorting by conductive metal is reduced, along with a decrease in signal-to-noise ratio.

The prior art also discloses keyswitch forces applied in line with the keyswitch assembly to displace conductive members and does not show structural arrangements for providing a mechanical advantage to produce a desired large displacement of the conductive shorting member by smaller key stroke travel as provided by the present invention.

BRIEF DESCRIPTION OF THE PRESENT INVENTION

In accordance with the present invention, a novel contactless keyswitch for keyboards is provided which includes structural arrangements and features for improved operation and also simpler and less expensive structure than prior art keyswitches. According to one of the preferred embodiments, this is accomplished by a sensing element including electromagnetic coupling wherein eddy-current shorting of the coupling is provided by a movable conductive metal member formed in a continuous sheet of resilient material wherein the metal member is hinged along continuous uncut portions and is normally biased by the resilience of the continuous sheet material to uniformly engage the keyswitch sensing circuit element located opposite the metal member on a printed circuit board of the keyswitch and keyboard. In this manner, a normally open keyswitch circuit is provided by eddy-current shorting of the sensing circuit element, e.g. close engagement of the conductive metal member and the interwound primary and secondary coils of a transformer on a printed circuit board.

In the preferred embodiments, the hinged metal member is formed in a resilient metal strip and is integral at hinged points to provide a resiliently biased door or flap which is moved by engagement of a key stem, passing through the circuit board at a point between the printed circuit element and the hinged points of the flap to provide a mechanical advantage in greater movement of the flap than the travel of the key stem or key.

In the preferred arrangement, one of the most important advantages is to provide a series of hinged metal members along a resilient metal strip wherein the members are located at spaced intervals equal to the standard spacing of keys on the keyboard, and the width of strips corresponds to the space between rows of keys on the keyboard. When the strips are secured to the underside of the circuit board, alternate strips are offset one-half the key spacing for locating the keys of alternate rows in a standard keyboard pattern.

Accordingly, it is an object of the present invention to provide a keyswitch which is more reliable and efficient in operation and more economical to manufacture by a simpler, novel arrangement of parts.

Another object is to provide a keyswitch providing improved signal transfer characteristics for compatible interfacing with present monolithic integrated circuits.

These and other objects and features of the present invention will become more apparent from the following detailed description of the preferred embodiments.

DESCRIPTION OF THE PREFERRED EMBODIMENT

Figure 1:
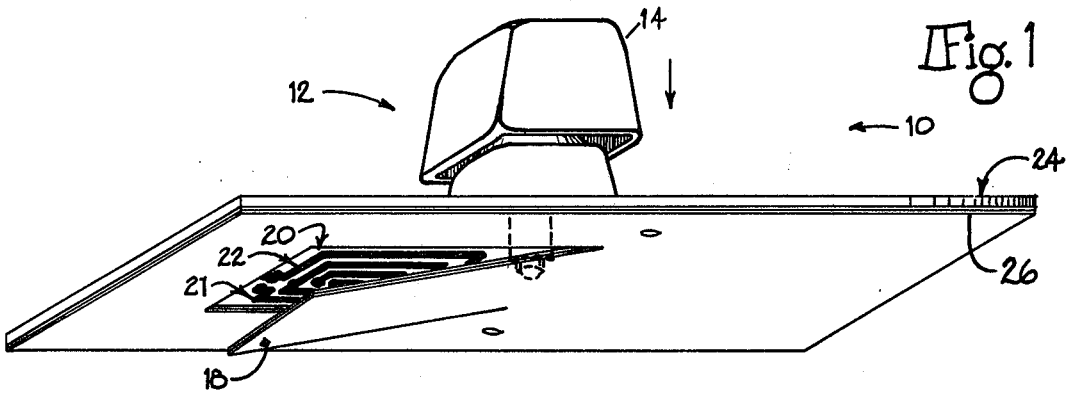
FIG. 1 is a pictorial view of the contactless keyswitch of the preferred embodiment including a section of the keyboard.
Figure 2:
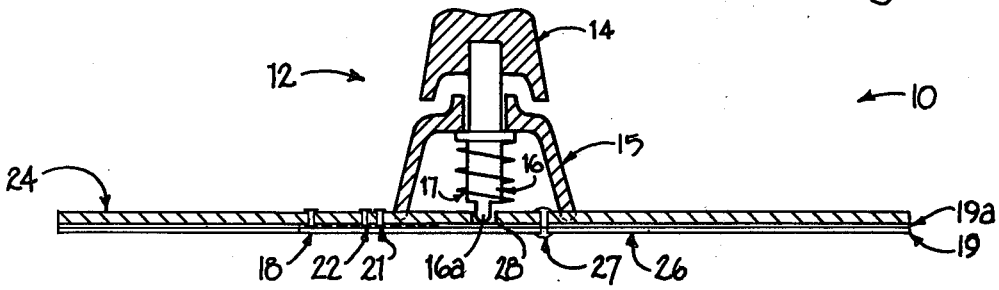
FIG. 2 is a sectional view of the keyswitch shown in FIG. 1 but in a non-actuated condition.
Figure 3:
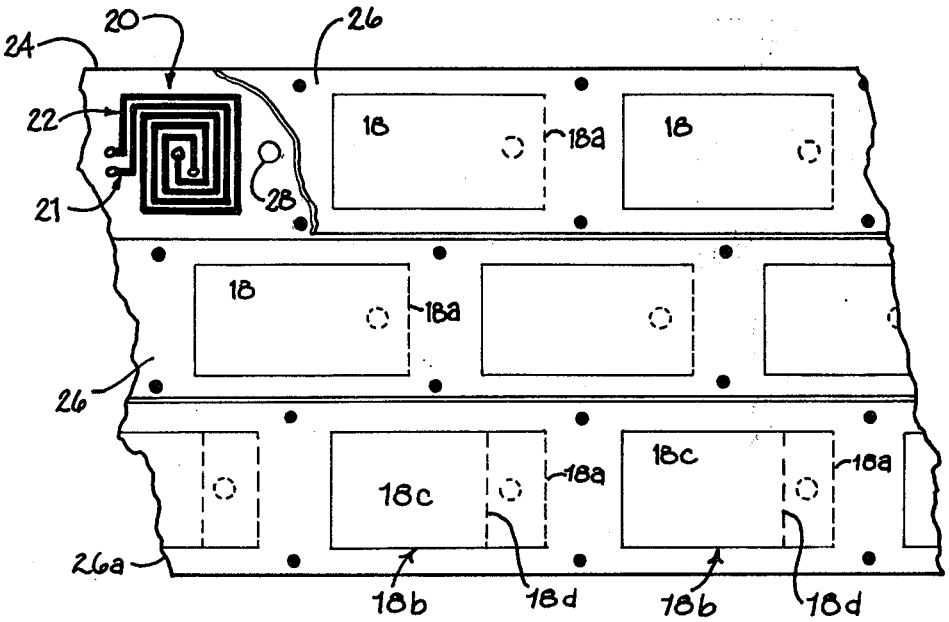
FIG. 3 is a partial view of the printed circuit board and resilient strips of the keyboard, partly broken away to show the internal structure thereof.

Referring now to the drawings, wherein like reference numerals refer to like or corresponding parts throughout the several views, there is shown in FIGS. 1, 2 and 3, detailed partial views of a keyboard 10 including a typical keyswitch, such as keyswitch assembly 12. In FIG. 2, assembly 12 is shown to comprise movable members including a key cap 14, a stem or plunger 16, surrounding helical return spring 17, and a hinged metal flap 18 formed in a continuous strip 26. The movable metal flap 18 is located below a stationary transformer 20 including interwound, concentric primary and secondary rectangular coils 21 and 22, each having multiple turns formed on a printed curcuit board 24. Preferably, the individual turns of primary and secondary coils 21, 22 are closely spaced for improved electromagnetic coupling. In the preferred embodiment, each coil consists of approximately five turns, e.g.

three to seven turns in an area of approximately 0.25 square inch.

In FIGS. 1–3, each metal flap 18 is preferably formed by stamping or cutting rectangular sections along only three sides, leaving an uncut side 18*a* in resilient strips 26. These strips 26 include laminated layers of thin conductive metal 19 and a thin insulating layer 19*a* as shown in FIGS. 2 and 3, for example. The strips 26 are resilient to provide for deflection of the flaps 18 about respective uncut sides without permanent deformation whereby flaps 18 return to the plane of the strips 26 for uniform contact over the area of coils 21 and 22, upon release and return of the movable members of the key assembly 12, as illustrated by the keyswitch assembly 12 in FIG. 2. The laminated strips 26 are secured to the lower side of the printed circuit board 24 between metal flaps 18 by rivets 27 or other fasteners, for example. Instead of rivets 27, a plastic housing 15 may include projections which extend through board 24 and strip 26 and secured therein by bonding by heat or sonic welding or plastic deformation. In many keyswitches 12, the return spring 17 is located between cap 14 and housing 15 on stem 17, i.e. inserted on stem 16 after housing 15 and before stem 16 is secured in the seat in cap 14.

One of the strips 26, strip 26*a* in FIG. 3, is preferably of slightly different construction to illustrate an alternate preferred embodiment of a continuous sheet or strip 26*a* having flaps 18*b* formed therein. The strip 26*a* is formed of resilient material, such as mylar, and conductive material formed on the flap 18*b*, at least in the area of the flap that overlaps the coils 21, 22 of transformer 20, i.e. the area of the flap defined by three cut edges and dashed line 18*d*.

The keyswitch 12 is shown in actuated condition in FIG. 1 wherein the flap 18 is deflected downwardly by pressure exerted on key cap 14, as indicated by the arrow. The pressure produces vertical downward movement of the stem 16 against the return bias of spring 17. The resiliency of the material in the hinge area at the continuous uncut end 18*a* holds metal flap 18 flat against the underside of circuit board 24 as shown in FIG. 2, for the nonactuated switch position.

The downward travel of the stem 16 is limited to the smaller diameter portion of the end 16*a*, which end 16*a* passes through the small aperture 28 in printed circuit board 24. In this manner, the deflection of conductive metal flap 18 is limited so as not to produce permanent deformation, i.e. deflection beyond the elastic limit of the sheet material.

A depressed keyswitch 12, as shown in FIG. 1, displaces the conductive metal flap 18 from both primary and secondary coils 21 and 22, printed on the lower side of the printed circuit board 24. In the depressed position of the key 12 as shown in FIG. 1, the closely spaced, coplanar primary and secondary coils 21 and 22 are not shorted by the conductive metal of displaced flap 18; and the electromagnetic fields, produced by a varying level of excitation of the primary coil 21, are inductively coupled to the secondary coil 22 to provide an output signal.

In the deactivated condition, upon the release of the key 12, for example, as shown in FIG. 2, key stem 16 is returned by the bias of return spring 17. The return of key stem 16 allows the flap 18 to return to its normal position, flat against both primary and secondary coils 21 and 22. The close proximity of the metal flap 18 to the coils 21 and 22 produces eddy-current shorting of both of these coils. The eddy-currents induced in the area of conductive metal of flap 18 adjacent both coils 21 and 22 effectively eliminates noise and outputs of the secondary coil 22. The absence of a signal at the output of the secondary coil 22 indicates that the keyswitch 12 is in the residual, deactivated condition.

In general, therefore, key actuation of the contactless keyswitch 12 of the present invention, is detected through the change in the coupling between the primary coil 21 and the sensing secondary coil 22 of transformer 20 which is located opposite the flap 18 in the printed circuit board 24. A typical keyboard 10 would consist of fifty-two transformers each including interwound primary and secondary coils 21 and 22 having a plurality of approximately three to seven turns.

Important structural features of the present invention are shown by the preferred embodiment shown in FIGS. 1 to 3 in which the laminated mylar-stainless steel or aluminum strips 26 (FIG. 3) are secured to the copper-clad side of the printed circuit board 24 on which side the opposing etched coils 21 and 22 of transformers 20 are located. This structural arrangement provides for normally decoupling by eddy-current shorting of both of the coils 21 and 22, of all the transformers 20 except for any selectively operated keyswitches 12, i.e. selected key being operated by pressing down the key cap 14 to move key stem 16 down and tapered end 16*a* thereof through the respective aperture 28. The tip of stem end 16*a* of any selected key pushes against the metal flap 18 and the length of travel of the key stem 16 or key stroke, causes the metal flap to be moved away from the coils 21 and 22 by a greater distance to at least substantially reduce or completely eliminate eddy-current shorting of coils 21 and 22 of transformer 20. The difference in signal level of the output of the secondary of the transformer 20 of the selected keyswitch 12 is sensed to detect which key has been operated during the particular time period. As illustrated in FIG. 3, the location of the metal strips 26 in the printed circuit board 24 positions the metal flaps 18 in a staggered relationship corresponding to the positions of the keyswitches 12 in adjacent rows, i.e. adjacent rows of keys on the keyboard 10 are offset so that keys of alternate rows are located along lines transverse to the key rows of the strips 26.

Another important feature of the preferred embodiment of the present invention is illustrated in FIG. 3 by the location of the apertures 28 in the printed circuit board 24. It should be noted as shown in FIG. 2 that the apertures 28 are located to pass the end 16*a* to engage the metal flap 18 at a predetermined fulcrum distance from the uncut or hinged edge 18*a* to provide the desired mechanical advantage so that a predetermined small travel of the key stem 16 will produce a greater amount of movement of the metal flap 18, as shown in FIG. 1. The resulant spacing of the metal flap 18 from the coils 21 and 22 will be more than adequate to reduce or eliminate eddy-current shorting of the coils for improved and enhanced output signals, i.e. elimination of eddy-current shorting of the coils 21 and 22 produces the greatest change in output signal level upon key actuation for improved detection of the selected key in a matrix detection and scanning circuit arrangement.

Figure 7:
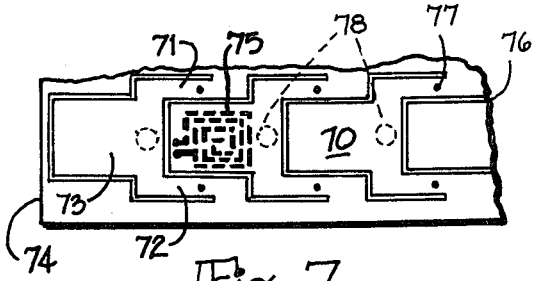
FIG. 7 is a partial view of a series of alternate preferred conductive flaps formed in a resilient sheet and secured to the circuit board for the keyswitch of the present invention.

A further advantage of the preferred embodiment which eliminates output signals from all but selected keyswitches of the keyboard, i.e. normally short circuited coils 21 and 22 of the nonactuated keys and primary to secondary coupling of coils 21 and 22 of actuated keys, is that the structural arrangement of the hinged metal flaps 18 provides for locating the aperture 28 and travel of the key stem end 16*a* outside of the area of the printed circuit coils 21 and 22, as clearly shown in FIG. 3. The improvement results from noninterference with the compact, closely spaced turns of the printed circuit coils. In the prior art, for example, an aperture located in the area of the coils requires that the turns of the coils be located about the aperture which would increase the spacing of the interwound turns of the coils. Further, there is a definite economic advantage in locating the aperture outside the area of the coils by avoiding close tolerances in positioning of the cooperating elements of the keyswitch assembly 12, relative positioning of keys of the keyboard 10 and other separate or integral but individual members. Of course, the advantage of etching the coils of the transformers on a circuit board, e.g. 100 transformers for corresponding keys of the keyboard, is obvious in view of the present disclosure. More important, the advantages are evident from forming by etching or stamping, for example, the thin resilient material in strips with hinged flaps 18 as shown in FIG. 3; or as shown in FIG. 7, flaps 70 which are bifurcated to provide transversely spaced hinge segments 71, 72 projecting laterally and longitudinally from the central area 73 of the individual flaps as illustrated in the alternate preferred embodiment of FIG. 7.

Figure 6:
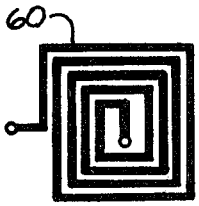
FIG. 6 is a single coil transformer as an alternate preferred circuit element.

In FIG. 6, a square, self-inductive transformer 60 is shown as an alternate transformer for the keyswitch 12 of the keyboard 10. In many cases, annular coils are preferred for increased inductive reactance in the same area. The operation of the transformer 60 is substantially the same as the operation of transformer 20 in the keyswitch 12 of FIGS. 1–3. The inductance of coil 60 energized by an alternating current signal, is eddy-current shorting by the conductive metal flap 18, or the metal flap 70 of FIG. 7, for example, to produce an output signal only when the flap is moved away from the coil, e.g. when the key is depressed in the preferred embodiments as shown. Such a key, having a transformer 60, is used for an individual function, independent of other keys in the keyboard system.

Figure 4:
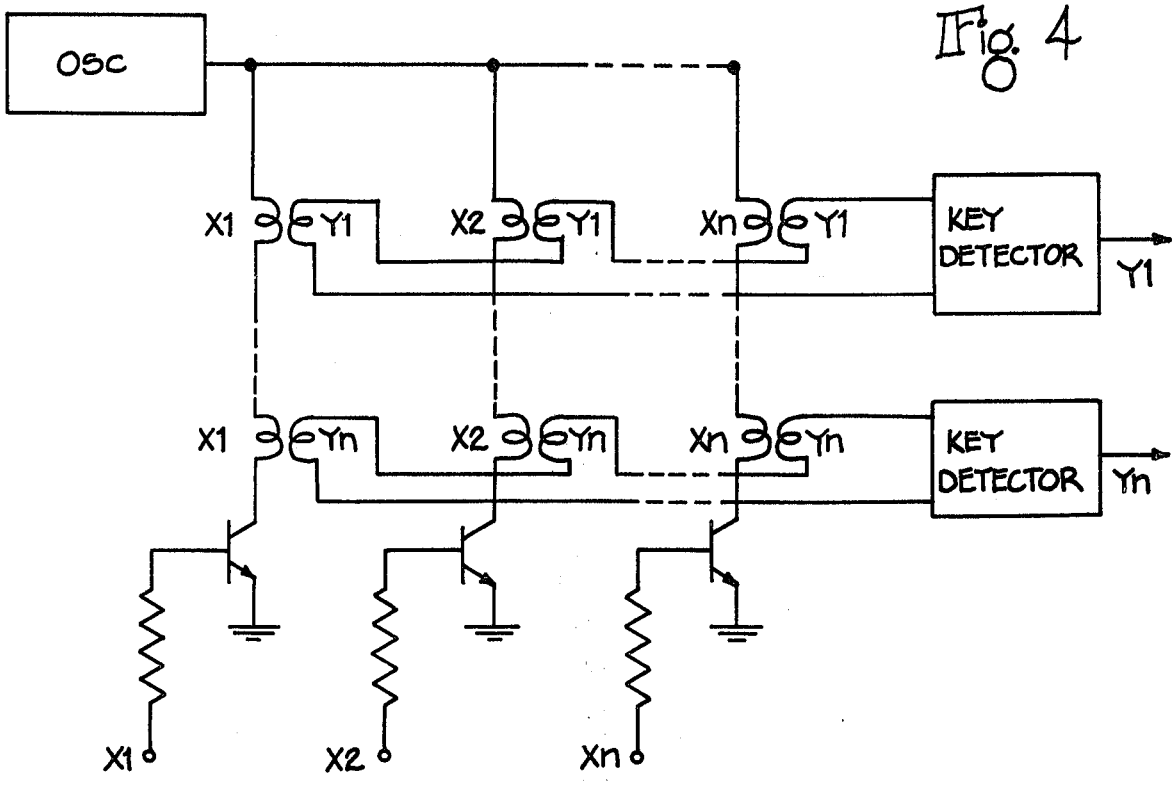
FIG. 4 is a schematic circuit diagram of a selective system for scanning the keyboard of the preferred embodiments.

Referring to FIG. 4, a typical keyboard scanning system is shown schematically to comprise an array of keyswitches schematically illustrated by the coordinate arrangement of transformers X*l*,Y*l* to X*n*,Y*n* having primaries in columns X*l*–X*n* connected to respective current driving transistors for X scan register outputs (units) coupled to corresponding column terminals X*l*–X*n*. The other coordinate selection is provided by sequential selection of each of the rows Y*l*–Y*n* by outputs of a Y scan register (tens). Accordingly, the output of the source, oscillator OSC provides sequential energization of the primaries of each of the keyswitches 12 having transformer coils X*l*,Y*l* to X*n*,Y*n* to produce a signal output at the corresponding one of Y*l*–Y*n* outputs where the selected one of the keyswitches is identified by the state of the X,Y registers or suitable scanning counter coupled to switches or gates for each column and row, for example. In FIG. 4, the switches or gates for the columns are illustrated by NPN transistors having bases connected to respective register outputs X*l*–X*n*. The row selection outputs are connected to enable sense amplifiers or gates for example, of the Key Detectors to selectively enable the Key Detectors having corresponding outputs Y*l*–Y*n*.

Figure 5:
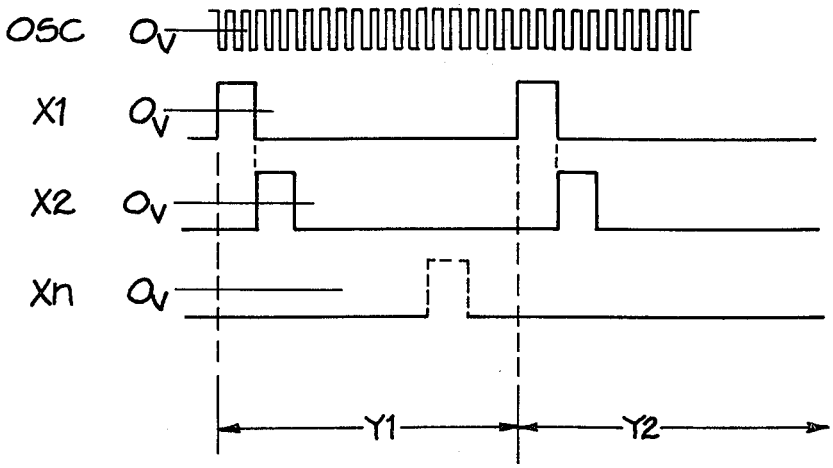
FIG. 5 is a timing diagram for illustrating the operation of the scanning system shown schematically in FIG. 4.

In operation, therefore, the timing diagram of FIG. 5 shows the high frequency energization selectively supplied by oscillator OSC to each keyswitch transformer X*l*,Y*l*–X*n*,Y*n* during the corresponding time interval of each selected keyswitch 12. Typical time intervals are defined by input pulses by corresponding terminals X*l*,X2–X*n* during each of the time periods Y*l*,Y2–Y*n*, for example, to provide sequential selection of each keyswitch in the first row Y*l* having time period Y*l* and then selection of each keyswitch X*l* in the next row until all the keyswitches in the array have been scanned, whereupon the scanning is repeated at the rate of approximately 100 KHz and complete scanning of all the keyswitches every millisecond, for example. Many other features and corresponding advantages of the present system are evident from the brief description of the scanning system for the keyswitches of the keyboards of the preferred embodiments of the present invention.

Referring now to FIG. 7, the alternate preferred embodiment of the present invention is shown to comprise a continuous strip or sheet 74 which is etched to form hinged flaps 70 including a main flap section 73 and laterally spaced, longitudinally extended hinge segments or legs 71 and 72. The hinge segments 71 and 72 are joined by the adjacent end portion of the main flap section 73 to form a C which substantially encloses the main flap section of the adjacent flap on the three free edges thereof.

The thin strip is secured by rivets 77 or other fasteners such as heat-staking as previously described for FIGS. 1–3, to a printed circuit board 76 having equally spaced transformers 75, preferably ¾ inch, located directly below the main section 73 of each of the flaps 70. Only three complete flaps 70 are shown by the part of the continuous strip 74 in FIG. 7. Preferably, the width of the strip is ¾ inch which corresponds to the standard row to row spacing and the flaps 70 are located every ¾ inch having the main flap sections centered to cover over the respective primary and secondary coils of the correspondingly located transformers 75. The view in FIG. 7 is the lower side of the keyswitch and keyboard. Accordingly, it should be evident that the structure of the preferred embodiment of FIG. 7 is an alternate structural arrangement of the elongated strips 26 and board 24 shown in FIG. 3. Further, the construction and operation corresponds to the previously described construction and operation of FIGS. 1 and 2, the strip 74, board 76 and metal flaps 70 being corresponding parts to strip 26, board 24 and flaps 18 of FIG. 3.

Referring again to FIG. 7, the important features of this preferred embodiment are described previously in connection with FIGS. 1–3, i.e. continuous strip, supported by the printed circuit board, etched or cut flaps in a resilient strip and locating the apertures for the key stems or plungers outside the area of the coils of the printed circuit transformers. In addition, the strip of flaps 70 provides integral but individual hinge segments 71, 72 of flaps 73. In this manner, any fatigue of the resilient material is practically eliminated by providing over the length of the individual hinges 71, 72. Accordingly, the life of the keyboard is not limited by flap structure which subjects a short length of hinge to stress during each key actuation.

It should be noted that the flap hinges 71, 72 are substantial, i.e., approximately ¼ the width of the flap to provide desired resiliency providing the return force necessary to make intimate contact between the main flap section and adjacent transformer coils 75. Thus, the eddy-current shorting of the transformer eliminates all electromagnetic coupling which would produce extraneous outputs. In this manner, the flaps of both preferred embodiments are directly overlapping corresponding transformer coils or windings including primary and secondary coils located in a single adjacent plane. This avoids problems encountered by prior arrangements in which the secondary coils are shielded by primary coils which reduces the effectiveness of eddy-current shorting of the secondary by a metal shield or disc.

While preferred embodiments of the invention have been disclosed in detail to provide an understanding of the present invention, it is apparent that many variations and other arrangements are made evident without departing from the scope of the invention as defined by the following claims.

We claim:

1. A contactless keyswitch comprising:

a circuit board having at least one reactive circuit element formed thereon; a sheet of material secured to said circuit board, said sheet including at least one movable, electrically conductive flap formed integrally therein, said flap being disposed opposite said circuit element and biased toward the circuit element; and keyswitch actuating means coupled to said flap to move the flap away from the circuit element to cause a change in reactance of said circuit element upon actuation of said switch.

2. The contactless keyswitch according to claim 1 in which said sheet of material is secured adjacent said reactive element so that said metal flap is normally biased against said circuit element.

3. The contactless keyswitch according to claim 1 in which said reactive element comprises planar, primary and secondary coils formed on said board.

4. The contactless keyswitch according to claim 3 in which said board comprises a printed circuit board and said primary and secondary coils comprise interwound coils formed on said circuit board.

5. The contactless keyswitch according to claim 1 in which said sheet of material consists of resilient material to provide resilient biasing of said flap toward the circuit element.

6. The contactless keyswitch according to claim 1 in which said sheet of material is formed of resilient insulating material and at least said flap consists of electrically conductive material for changing the reactance of said circuit element upon movement of said flap.

7. The contactless keyswitch according to claim 1 in which said keyswitch actuating means includes a key and keystem, said key being located on said board and opposite said flap so that said keystem passes through said board to engage said flap to produce a mechanical advantage in moving the flap a greater distance than the distance of travel of said key.

8. The contactless keyswitch according to claim 1 in which said keyswitch actuating means comprises a key and stem which are disposed on the opposite side of the board from said circuit element and flap, said flap having a hinged area at one end thereof and said keystem passing through an aperture in the board, said aperture being located outside the area of said circuit element to engage the flap between the hinge area and the area of the circuit element to produce greater distance of movement of the flap over the circuit element area than the distance of movement of said keystem.

9. A keyboard comprising:

a circuit board;

a plurality of keyswitch actuating means disposed on one side of said board, said actuating means including keys and keystems located to pass through corresponding apertures in said board upon actuation thereof;

a plurality of circuit elements formed on the opposite side of said board, and a strip of resilient material secured to said opposite side and over said circuit elements;

said strip of material including partially severed areas forming a plurality of flaps, said flaps being located opposite respective ones of said circuit elements, said flaps being hinged along unsevered portions integral with said strip and resiliently biased by said portions against respective circuit elements;

said flaps including electrically conductive material for changing the reactance of opposing circuit elements in response to operation of said keyswitch actuating means having keystems located to engage and move respective ones of said flaps.

10. The keyboard according to claim 9 in which said circuit elements comprise transformers having interwound planar, primary and secondary coils.

11. The keyboard according to claim 10 in which each of said planar, primary and secondary coils include a plurality of turns.

12. The keyboard according to claim 9 in which said actuating means comprises a plurality row of keys, each row including keystems passing through said board to engage respective flaps of said strip; and said rows of keys being offset and corresponding strips of adjacent rows are located to position flaps opposite respective keystems to produce a mechanical advantage in moving the flaps a greater distance than said keystems.

* * * * *